United States Patent [19]

Vollmer

[11] Patent Number: 4,895,180

[45] Date of Patent: Jan. 23, 1990

[54] ANTI-BACKFLOW VALVE

[75] Inventor: Rudolf Vollmer, Mosbach, Fed. Rep. of Germany

[73] Assignee: Honeywell GmbH, Fed. Rep. of Germany

[21] Appl. No.: 339,280

[22] Filed: Apr. 17, 1989

[30] Foreign Application Priority Data

Apr. 26, 1988 [EP] European Pat. Off. ..... EP88106643

[51] Int. Cl.[4] ..... E03C 1/10

[52] U.S. Cl. ..... 137/117; 137/218

[58] Field of Search ..... 137/117, 107, 115, 116, 137/218

[56] References Cited

U.S. PATENT DOCUMENTS 4,207,915 6/1980 Becker ..... 137/117

*Primary Examiner*—Alan Cohan

*Attorney, Agent, or Firm*—Mitchell J. Halista; Albin Medved

[57] ABSTRACT

An anti-backflow valve to prevent back-flow of water within a water supply line comprises a cross-shaped housing arranged symmetrically with respect to a vertical center axis. A diaphragm is clamped between the housing and a cover and acts via a valve stem upon a relief valve. Parallel to the valve stem and located on each side of it are two check valves arranged within bores of the housing. Both check valves as well as the relief valve are arranged in a plane containing an inlet and outlet of the housing to produce a compact and symmetrical configuration which is easily inserted into a water supply line.

7 Claims, 1 Drawing Sheet

ANTI-BACKFLOW VALVE

BACKGROUND OF THE INVENTION

1. Field of the Invention

The present invention relates to an anti-backflow valve for preventing backflow of water into a water supply line.

2. Description of the Prior Art

Conventional anti-backflow valves comprise two check valves connected in series and a relief valve for venting the connecting passage between both check valves. Such a backflow prevention valve is shown in U.S. Pat. No. 4,207,915. This known backflow prevention valve comprises an offset vertical and parallel arrangement of all internal valves so that upon removal of a cover those valves can be easily replaced or may be serviced, respectively, without removing the whole backflow prevention valve unit from the supply line. The check valves are of similar design, but there are different mounting means provided for each check valve so that no danger of incorrect insertion exists. However, that known backflow preventer has its relief valve offset from the plane in which the two check valves are arranged which results in a bulky valve unit of unsymmetrical design.

SUMMARY OF THE INVENTION

It is an object of the present invention to provide an anti-backflow valve which incorporates a compact and symmetrical design and which fits easily into a water supply line.

In accomplishing this and other objects, there has been provided, in accordance with the present invention, an anti-backflow valve comprising a housing having an inlet, an outlet and a discharge port, a first check valve, a second check valve, a chamber connecting the first and second valves in series and in a common flow direction, a relief valve connected to said chamber, a cover for closing said housing, a diaphragm, said cover clamping said diaphragm to said housing, a valve stem, said diaphragm suspending said valve stem for acting on said relief valve, a chamber above the diaphragm connected to the inlet pressure with said check valves being arranged parallel to the valve stem of the relief valve, the improvement comprising a cross-shaped housing within which both said check valves as well as said relief valve are arranged in one plane including said inlet and said outlet.

BRIEF DESCRIPTION OF THE DRAWINGS

A better understanding of the present invention may be had when the following detailed description is read in connection with the accompanying drawings, in which.

DESCRIPTION OF THE PREFERRED EMBODIMENT

Figure 1:
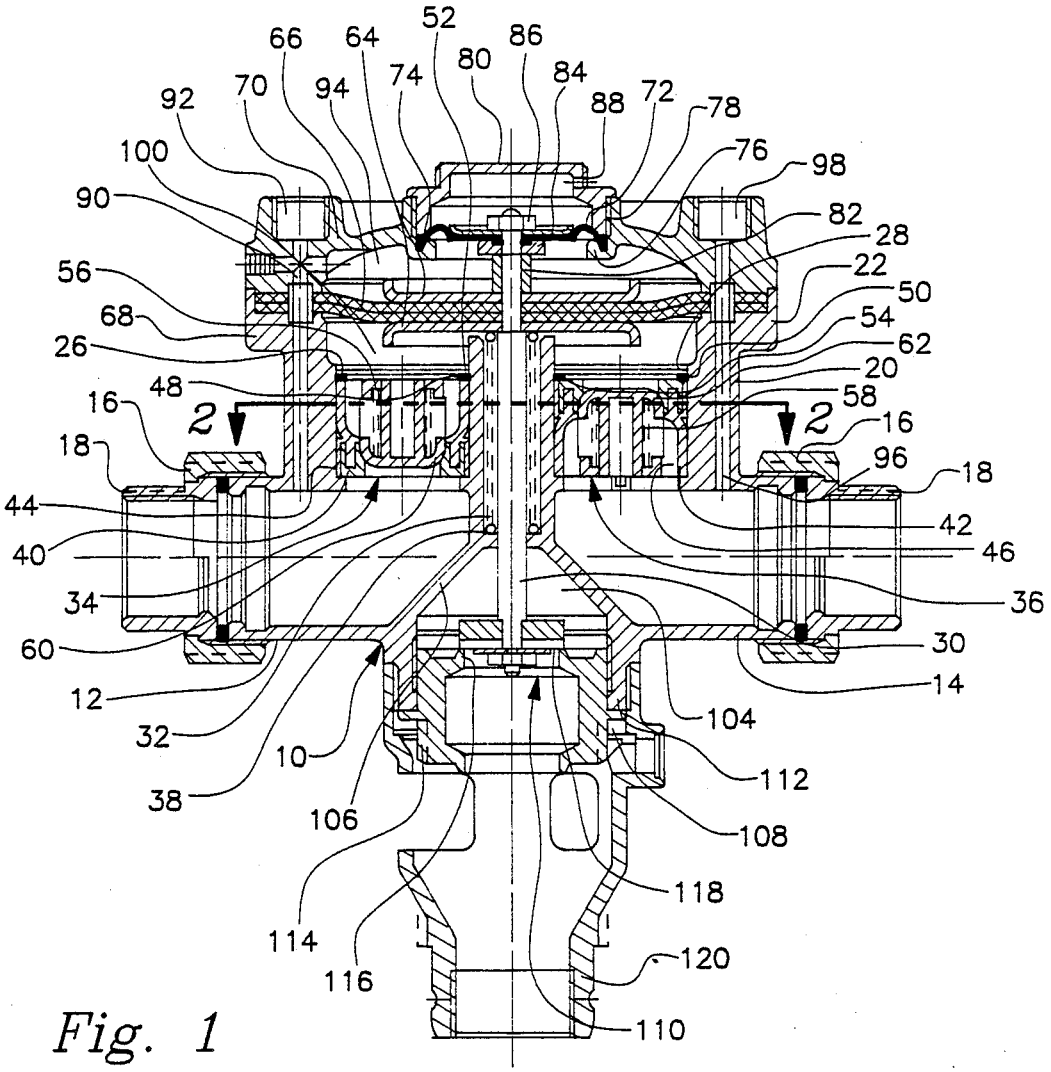
FIG. 1 is a cross-sectional view of an anti-backflow valve embodying an example of the present invention.

As shown in FIG. 1, the valve unit of the present invention comprises a cross-shaped housing 10 having in axial alignment a water inlet 12 and a water outlet 14. By means of pipe couplers 16,16' the inlet and outlet 12,14 may be connected to an incoming and outgoing water supply lines 18,18A. Not shown are shut-off valves, which may be arranged upstream and downstream of the valve unit in the water supply lines 18,18A which are closed when valve maintenance, e.g., a replacement of the valve or components has to be performed.

The housing 10 above the inlet and outlet 12 and 14 comprises a square-shaped housing portion 20, which is integrally attached to a cup-shaped portion 22. The square-shaped housing portion 20 is provided with a central bore 24 and, on each side of this central bore 24, two further bores 26 and 28. All the bores 24 to 28 are provided with suitable respective diameters in order to allow reception of a valve stem 30 and a restoring spring 32 surrounding said valve stem 30 within said central bore 24 and to allow reception of check valves 34 and 36 within the two remaining bores 26 and 28. The restoring spring 32 abuts against a shoulder 38 in the bore 24, and the check valves 34 and 36 abut with their valve seat bodies 40 and 42 at shoulders 44 and 46. Both valve seat bodies 40 and 42 are retained in their shown position by spring washers 52 and 54 gripping respective grooves 48 and 50. Closing bodies 60 and 62 biased by strong differently dimensioned springs 56 and 58 abut against valve seats at the valve seat bodies 40 and 42.

The valve stem 30 is connected to a diaphragm 66 by means of diaphragm disks 64, and the diaphragm is clamped between a flange shoulder 68 of the cup-shaped housing portion 22 and a cover 70. The connection of the cover to the housing is made by suitable screws (not shown). The valve stem 30 extends through the diaphragm 66 and through an additional diaphragm 72 having a smaller diameter which is inserted in a central cut-out 74 within the cover 70 having a flange shoulder 76 extending inwardly. The effective diameter of the diaphragm 72 corresponds to the diameter of the valve seat 116. The cut-out 74 comprises an inner thread 78 into which a cap 80 having an outer thread is threaded in order to clamp the diaphragm 72 between said flange shoulder 76 and the cap. A distance sleeve 82 and a biasing disk 84 provide for a constant distance between both diaphragms 66 and 72, and a nut 86 threaded onto the end of the valve stem 30 clamps the whole device. The cap 80 is provided with a vent opening 88.

The chamber 94 between both diaphragms 66 and 72 is connected to the water inlet 12 by means of a channel 90. Furthermore, a control plug 92 is provided within the cover 70, at which the input pressure may be measured. In the same manner, a channel 96 connects the water outlet 14 to a control plug 98 within the cover 70 at which the output pressure may be measured.

Figure 2:
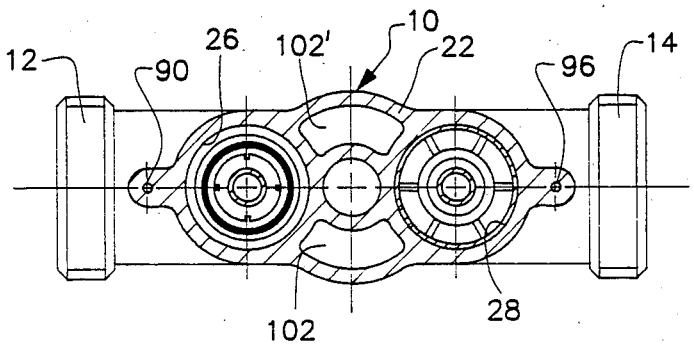
FIG. 2 is a cross-sectional illustration along line 2—2 in FIG. 1.

A further control plug (not shown) within the cover 70 allows measuring of the pressure between a chamber 100 between the backside of the check valve 34 and the front side of the check valve 36. This chamber 100 by means of cut-outs 102, 102' (shown in FIG. 2) is connected to an output chamber 104 which is confined by two partition walls 106, 108 and a relief valve 110. The relief valve 110 is seated within a discharge port 112 which extends downward and concentrically to the valve stem 30. The check valves 34,36, the relief valve 110, the inlet 12, the outlet 14 are arranged in a common plane to provide compact and symmetrical configuration. A valve seat body 114 is screwed into the discharge port 112, and a valve seat 116 of the body 114 acts together with a closing body 118 arranged at the lower end of the valve stem 30. Finally, a discharge funnel 120 is threaded into the discharge port 112.

In operation, under no water flow and static pressure conditions, if the water pressure at the inlet 12 exceeds the pressure within the chamber 100, 104 and if this pressure in the chamber 100 exceeds the pressure at the outlet 14, both check valves 34 and 36 are closed. Furthermore, the relief valve 110 is kept in its closed position by means of the differential pressure acting onto the diaphragm 66.

If a water flow takes place, then the differential pressure between the inlet 12 and the outlet 14 increases. During a water flow, both check valves are opened, and water flows from the inlet 12 to the outlet 14. Due to the biasing springs 56 and 58 of the check valves 34 and 36, stepwise reduced pressures result from the inlet to the outlet via the chamber 104 inbetween. Those pressure conditions are such that the relief valve 110 remains in its closed position due to the differential pressure acting upon the diaphragm 66. If the differential pressure between the inlet stud 12 and the chamber 104 inbetween falls below a predetermined value, then both check valves 34 and 36 are closed and the relief valve 110 is opened so that backflow from the outlet to the inlet is not possible and the chambers 100, 104 inbetween are vented or drained, respectively, by means of the relief valve 110. Also, in the event where one or both check valves are not closing tightly, a pressure increase at the outlet or a reduced pressure at the inlet does not result in backflow of water within the line since the relief valve 110 is in an open position.

Accordingly, it may be seen that there has been provided, in accordance with the present invention, an improved anti-backflow valve.

The embodiments of the present invention in which an exclusive property or privilege is claimed are defined as follows:

1. In an anti-back flow valve for preventing backflow of fluid in a fluid supply line having a housing having an inlet, an outlet and a discharge port, a first check valve, a second check valve, a chamber connecting said first and second valves in series and in a common flow direction in said housing, a relief valve connected to said chamber between said first and second check valves, a cover for closing said housing, a diaphragm, said cover clamping said diaphragm to said housing, a valve stem, said diaphragm suspending said valve stem for acting on said relief valve, a chamber above the diaphragm connected to the inlet pressure with said check valves being arranged parallel to the valve stem of the relief valve, the improvement comprising a cross-shaped housing within which both said check valves as well as said relief valve are arranged in one plane including said inlet and said outlet.

2. A valve according to claim 1 wherein said chamber between both check valves is arranged below said diaphragm and is connected by means of at least one connecting cut-out in said housing to an output chamber which is ventable by said relief valve.

3. A valve according to claim 2 wherein said relief valve is arranged within said discharge port which is concentrical to a vertical symmetry axis of said housing.

4. A valve unit according to claim 3 and further including a valve seat body is threaded into said discharge port with said body comprising a valve seat acting together with a closing body at said valve stem.

5. A valve unit according to claim 4 wherein said housing comprises two partition walls which separate said inlet from the outlet and which form said output chamber ventable by said relief valve.

6. A valve unit according to claim 2 and further including connecting cut-outs provided within said housing which encompass said valve stem inbetween and which are offset by 180° with respect to each other.

7. A valve unit according to claim 6 wherein said valve stem is suspended by a further diaphragm having an effective diameter which corresponds to the diameter of said valve seat of the relief valve.

* * * * *